US006375018B1

(12) United States Patent
Clement

(10) Patent No.: US 6,375,018 B1
(45) Date of Patent: Apr. 23, 2002

(54) JEWELRY SUPPORT RACK

(76) Inventor: Gerald Vaughn Clement, 45 Creek Rd., Fairfax, CA (US) 94930

( * ) Notice: Subject to any disclaimer, the term of this patent is extended or adjusted under 35 U.S.C. 154(b) by 0 days.

(21) Appl. No.: 09/714,063

(22) Filed: Nov. 15, 2000

(51) Int. Cl.[7] ..... A47G 29/00
(52) U.S. Cl. ..... 211/85.2
(58) Field of Search ..... 211/85.2, 70.1, 211/13.1, 72; 206/6.1

(56) References Cited

U.S. PATENT DOCUMENTS 3,685,660 A * 8/1972 Saunders
4,264,013 A * 4/1981 Vollmer
5,067,617 A * 11/1991 Caldwell et al.

* cited by examiner

*Primary Examiner*—Alvin Chin-Shue
*Assistant Examiner*—Sarah Purol

(74) *Attorney, Agent, or Firm*—Risto A. Rinne, Jr.

(57) ABSTRACT

An apparatus for the storage and display of articles of jewelry includes a plurality of plastic strips that are disposed in parallel alignment with respect to each other and which each include a pair of spaced apart openings on each end thereof that are adapted for placement over a pair of posts. The pair of posts are disposed in a parallel spaced apart relationship with respect to each other. Each of the plastic strips includes a plurality of fingers that protrude slightly outward and away from the posts and are adapted to receive and to retain an article of jewelry that may be suspended therefrom. The posts are retained in position in a cabinet. The strips are retained in position along the pair of posts unless the strips are acted on by a force which tends to urge them in either direction along the longitudinal length of the pair of posts. The strips may be urged either closer together or further apart to accommodate various sizes of jewelry items. A brace is preferably used to retain the pair of posts in a proper spaced-apart relationship. The cabinet includes a door that is hingedly attached to a rear half and, when closed, is used to protect the jewelry from the elements and also to conceal the jewelry and, if desired, for purposes of transport.

11 Claims, 2 Drawing Sheets

JEWELRY SUPPORT RACK

BACKGROUND OF THE INVENTION

1. Field of the Invention

The present invention, in general relates to support racks and, more particularly, to devices that support jewelry.

Jewelry is stored at home and in shops with two primary objectives in mind. First, it must be easy to access and second it must be easy to see.

For example, when jewelry is placed on a jewelry box it mixes with the other jewelry and may become tangled with other pieces. Clearly, jewelry items that have become tangled with other pieces are difficult and time consuming to remove.

It is also difficult to discern the exact attributes of the piece that is being selected, such as its various colors when various articles of jewelry are clustered together, such as in a jewelry box and even more difficult to do so when the jewelry is entangled with other items. This is important in color coordinating the jewelry with other jewelry items that are being worn or clothing articles.

The problem exists for those who have jewelry at home in that they would like easy viewing of their jewelry items as well as easy placement and easy removal. It is also desirable to be able to store jewelry at home so that it is out of sight when it is not needed, and yet easy to access when it is wanted. Concealment is an important consideration for security purposes.

In commercial applications, the need to prominently display jewelry is great as is the need to safeguard it from possible theft or loss. There is also a need in commercial applications for a jewelry support rack that can easily be used to transport a number of jewelry articles from one location to another, for example from one show to another.

There is a further need to be able to rapidly either set up the jewelry support rack for use at the show and to quickly take it down after the show has concluded.

Cost is also a factor. Both home and commercial applications would benefit from an inexpensive solution that can well satisfy these needs.

Another problem that has been vexing to the industry as well is how to readily accommodate the odd shapes and variable lengths of jewelry items. Some earrings, for example, are short while others are especially long. Some items can be placed side by side in close proximity whereas other jewelry items require a greater distance separating them. Accordingly, a jewelry support rack that can be adjusted to accommodate a great variety of sizes of jewelry items is needed.

Accordingly, there exists today a need for a jewelry support rack that is adjustable, inexpensive to manufacture, fast and easy to close and transport, easy to place articles of jewelry upon and easy to remove articles therefrom, and which, when open, provides unobstructed viewing of the jewelry items.

Clearly, such an apparatus would be a useful and desirable device.

2. Description of Prior Art

Jewelry support racks are, in general, known. For example, the following patents describe various types of these devices as well as other devices, some of which may be similar in appearance but which are unrelated in purpose:

U.S. Pat. No. 5,762,184 to Greiner, Jun. 9, 1998;

U.S. Pat. No. 5,692,605 to Lai, Dec. 2, 1997;

U.S. Pat. No. 5,551,772 to Keffer, Sep. 3, 1996;

U.S. Pat. No. 5,511,873 to Mech, Apr. 30, 1996;

U.S. Pat. No. 5,242,048 to Ellingsworth et al., Sep. 7, 1993;

U.S. Pat. No. 5,168,986 to Stenhouse, Dec. 8, 1992;

U.S. Pat. No. 5,087,105 to White, Feb. 11, 1992;

U.S. Pat. No. 5,067,617 to Caldwell et al., Nov. 26, 1991;

U.S. Pat. No. 4,966,287 to Snyder, Oct. 30, 1990;

U.S. Pat. No. 4,776,650 to Ferenzi, Oct. 11, 1988;

U.S. Pat. No. 4,775,053 to Geiger, Oct. 4, 1988;

U.S. Pat. No. 4,322,007 to Feibelman, Mar. 30, 1982;

U.S. Pat. No. 4,093,077 to Strasser, Jun. 6, 1978;

U.S. Pat. No. 3,641,615 to Peasley, Feb. 15, 1972;

U.S. Pat. No. 3,071,640 to Langlie et al., Jan. 1, 1963;

U.S. Pat. No. 2,961,479 to Bertling, Nov. 22, 1960;

U.S. Pat. No. 2,508,491 to Cayo, May 23, 1950;

U.S. Pat. No. 1,442,424 to Chapman, Jan. 16, 1923;

U.S. Pat. No. 334,413 to Bachand, Jan. 19, 1886; and

U.S. Design Pat. No. D276,212 to Villanueva, Nov. 6, 1984.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a jewelry support rack that is inexpensive to manufacture.

Another object of the invention is to provide a jewelry support rack that is able to display different size and length articles of jewelry.

Still another object of the invention is to provide a jewelry support rack that is easy to transport.

Still yet another object of the invention is to provide a jewelry support rack that includes a cabinet.

Yet another important object of the invention is to provide a jewelry support rack that is easy to place jewelry items thereon and easy to remove jewelry items therefrom.

Still yet another important object of the invention is to provide a jewelry support rack that permits optimum viewing of each article of jewelry that it supports.

Briefly, a jewelry support rack apparatus that is constructed in accordance with the principles of the present invention has a pair of spaced apart posts that are supported in a cabinet. A plurality of flat plastic strips (when not disposed on the posts) each includes a pair of spaced apart holes on each end. Each strip includes a plurality of spaced apart fingers disposed on one side along a longitudinal length thereof. The pair of holes on each end is adapted to be placed over the post on that end. When the spaced apart holes of the strip are disposed on each of the posts, the fingers are urged outward and away from the strip thereby permitting jewelry items to be readily placed on any of the fingers, as desired. The strips can be displaced up or down along the posts to accommodate jewelry items of varying length. A brace that includes a pair of spaced apart holes that correspond with the distance the posts are disposed apart may be placed over the posts as well to act as a support to ensure proper spacing of the posts.

DETAILED DESCRIPTION OF THE INVENTION

Figure 1:
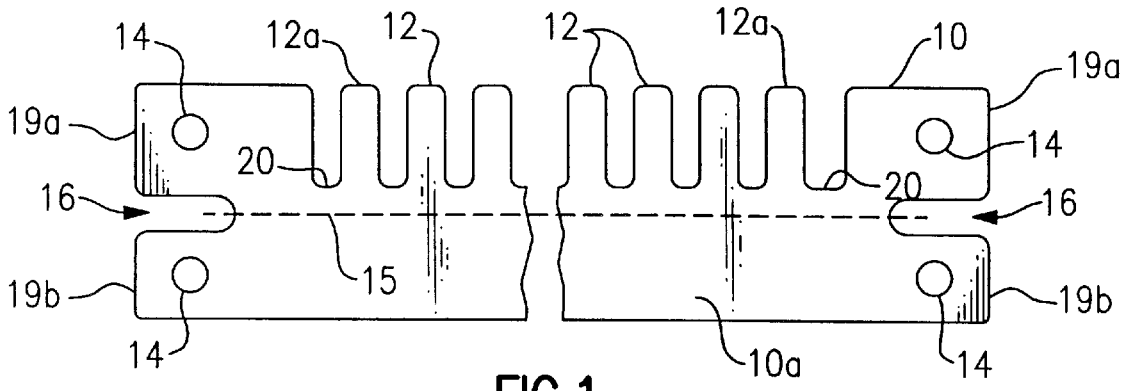
FIG. 1 is a plan view of one of the plastic strips.

Referring to all of the drawings and in particular to FIG. 1 is shown, a plastic strip, identified in general by the reference numeral 10. A plurality of strips 10 are normally used.

The strip 10, as shown, is disposed in a flat orientation, similar to that after manufacture and before use, which is described in greater detail hereinafter.

The strip 10 includes a plurality of fingers 12. Articles of jewelry (not shown) are normally hung from the fingers 12.

A pair of holes 14 is disposed on each side of the strip 10 in a spaced apart relationship that is equidistant from a central longitudinal axis 15 of the strip 10.

A notch 16 is provided on each end of the strip 10 that protrudes into the strip 10 a predetermined length. The depth of the notch 16 is dependent upon several factors, one of which is the type of plastic material that the strip 10 is formed of and another factor is how thick the strip 10 is. As is described in greater detail hereinafter, the two notches 16 facilitate bending of the strip 10 about the longitudinal axis 15.

Figure 2:
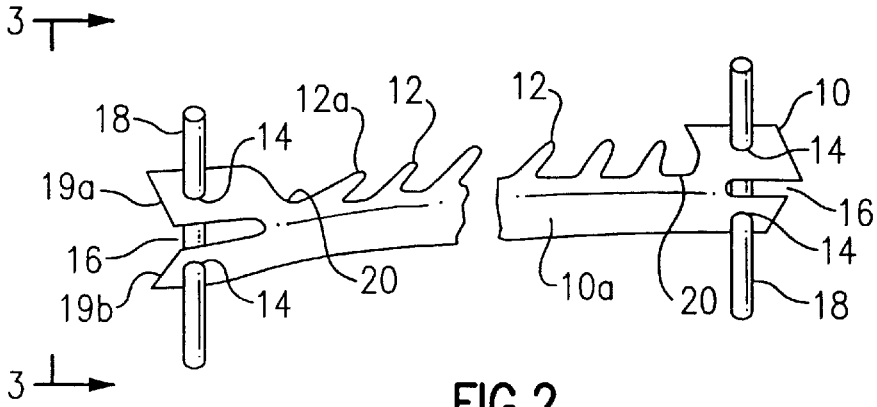
FIG. 2 is a view in perspective of the plastic strip of FIG. 1 placed over a pair of posts.

Referring now in particular to FIG. 2, a pair of posts 18 are shown in a parallel spaced apart relationship with respect to each other. For certain applications (i.e., where a smaller compact version is desired) the spacing of the posts 18 will be less than for other applications.

The strip 10 is bent at the ends so as to permit each of the holes 14 on each end of the strip 10 to pass over one of the posts 18. The process is repeated for the other post 18, as well.

By applying a slight compressive force to a first end 19*a* of the strip 10 that urges it toward a second end 19*b*, the tension that is applied to the post 18 (on that end) is lessened and the strip 10 may easily be displaced up or down (longitudinally) along the length of the post 18. By simultaneously urging the first and second ends 19*a*, 19*b* together on both ends of the strip 10, the entire strip may be displaced longitudinally along both of the posts 18. Removing the compressive force retains the strip 10 where it was displaced along the longitudinal length of the posts 18.

As the strip 10 is placed over the posts 18, the first and second ends 19*a*, 19*b* are forced into an angle sufficient to align the holes 14 with each post 18.

A first notch 20 that is disposed between each of the first ends 19*a* and a first finger 12*a* on each end of the strip 10 permits that portion of the strip 10 to flex sufficient so that the first end 19*a* is able to angle back toward the post 18 while permitting the fingers 12 to remain pointing out and away from the posts 18.

Other notches similar to the first notch 20 in appearance are disposed intermediate each of the fingers 12, but it is the first notch 20 that permits the first ends 19*a* to angle back toward the posts 18 while isolating the fingers 12 from having to bend back toward the posts 18.

Figure 3:
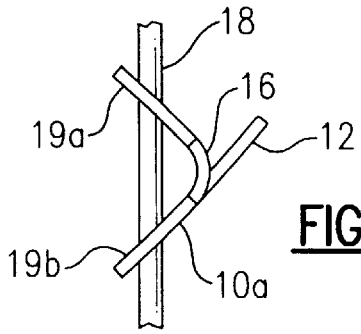
FIG. 3 is a cross sectional view taken on the line 3—3 in FIG. 2.

Referring now in particular to FIG. 3, the fingers 12 remain substantially in planar alignment with a lower half 10*a* of the strip 10 that is disposed on one side of the longitudinal axis 15. This results in the fingers 12 protruding out and away from the posts 18 into a convenient position for placing the jewelry items thereon.

Figure 4:
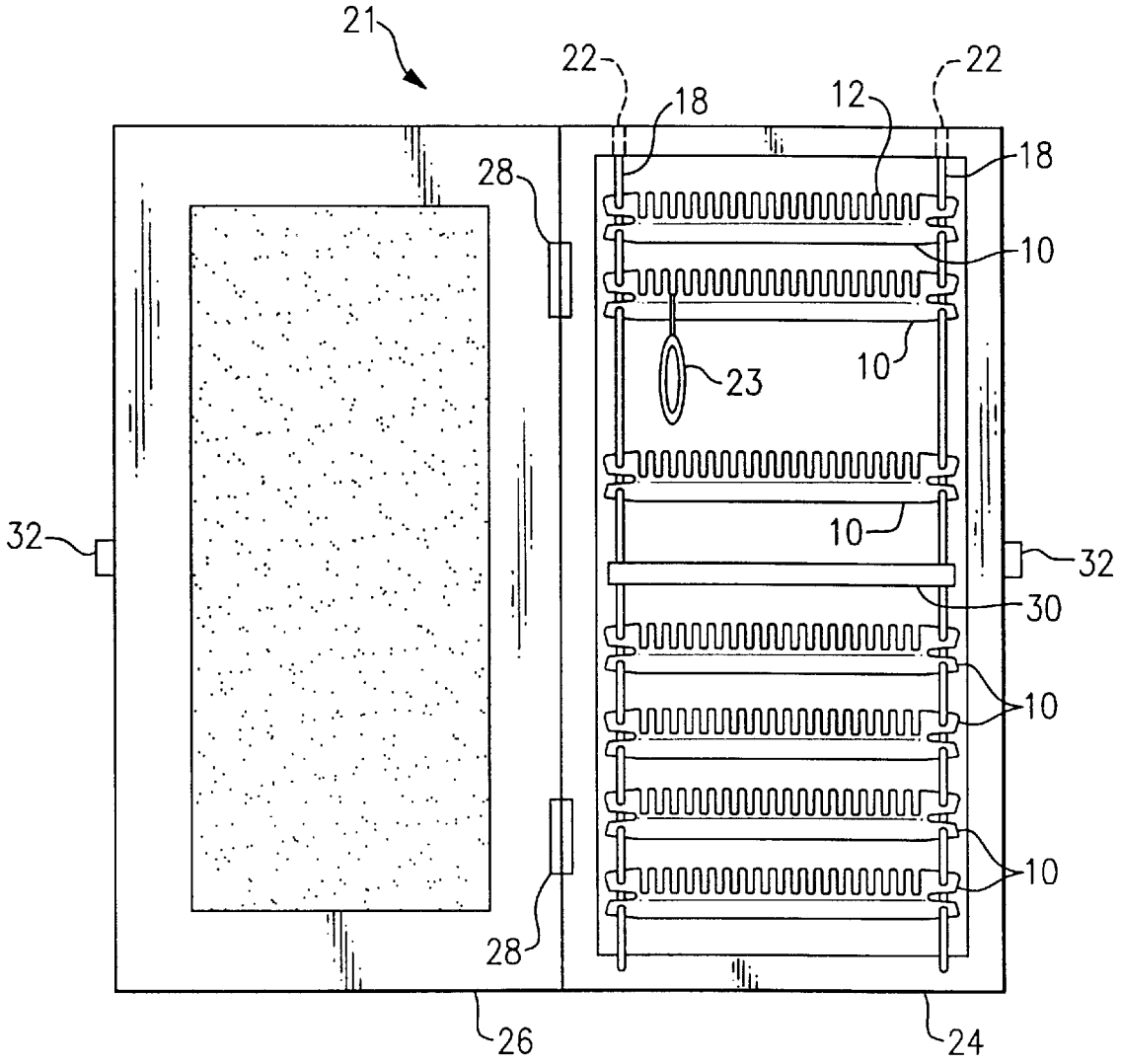
FIG. 4 is a front view of the jewelry support rack in an open cabinet.

Referring now in particular to FIG. 4, a plurality of strips 10 are shown disposed over the posts 18 which are contained in a cabinet, identified in general by the reference numeral 21.

The strips 10 are disposed in a parallel orientation with respect to each other and the spacing from one strip 10 to another is varied to accommodate a large jewelry item 23, such as a long earring.

The posts 18 slide through a pair of top holes 22 in a rear half 24 of a cabinet 21 that also includes a door 26 that is pivotally attached about a pivot axis to the rear half 24 by a pair hinges 28.

A brace 30 that includes a pair of spaced apart holes that correspond with the distance the posts 18 are disposed apart is placed over the posts 18 and acts as a support structure to ensure that the posts 18 are maintained in a proper spaced apart orientation with respect to each other.

Additional braces 30 (not shown) may be used as well as greater or fewer strips 10.

When the door 26 of the cabinet 21 is opened, easy viewing of all articles of jewelry (the long jewelry item 23 and others [not shown]) as well as easy access thereto is provided. It is easy to view and it is easy to place or to remove the jewelry items from the fingers 12.

The door 26 can be readily closed to protect and conceal the jewelry and it can be secured in a closed position with respect to the rear half 24 of the cabinet 21 by any type of a latch 32 that is preferred.

Once closed the cabinet 21 and all of the jewelry may be readily transported where desired, for example to shows. It may similarly be rapidly set up for display at a show by opening the latch 32 and pivoting open the door 26. When the door 26 is opened at an angle that is less than 180 degrees with respect to the rear half 24, a stable self-standing display case for the jewelry items is attained.

If desired, a glass covering (not shown) may be applied over the jewelry items for added security such as for use at shows.

Other changes, for example the manner in which the posts 18 are added to and removed from the cabinet 21 are anticipated. The cabinet 21 may be formed of any desired material, such as wood or plastic, or other materials. The brace 30 may similarly be formed of wood or any other preferred material.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A jewelry support rack, comprising:

(a) a pair of posts disposed in a parallel spaced apart relationship with respect to each other;

(b) at least one strip having a length that exceeds the distance between said pair of posts and including a pair of spaced apart openings disposed on each end thereof, said strip adapted to be bent at each end sufficient to permit said pair of openings to be disposed over one of said pair of posts on one end of said strip and to permit another of said pair of openings to be disposed over another of said pair of posts on an opposite end of said strip, whereby said strip is adapted to remain in position relative to said pair of posts unless acted upon by a force applied thereto and whereby said strip is adapted to be urged longitudinally along said pair of posts subsequent to said force being applied thereto; and (c) means for suspending at least one article of jewelry from said strip.

2. The jewelry support rack of claim 1 wherein said strip is adapted to be urged longitudinally along said pair of posts subsequent to said force being applied at each end of said strip sufficient to urge a first end disposed on a first side of said strip toward a second end disposed on said first side.

3. The jewelry support rack of claim 2 wherein said strip is adapted to be urged longitudinally along said pair of posts subsequent to a second force being applied at an opposite end of said strip sufficient to urge a first end disposed on a second side of said strip toward a second end disposed on said second side simultaneous when said force is applied to said first side of said strip.

4. The jewelry support rack of claim 1 wherein said means for suspending includes a plurality of fingers formed in said strip along a first side thereof, said first side extending substantially along a longitudinal length of said strip.

5. The jewelry support rack of claim 4 wherein said plurality of fingers are adapted to extend outward away from said pair of posts when said strip is disposed over said pair of posts.

6. The jewelry support rack of claim 5 wherein said plurality of fingers are adapted to remain substantially in parallel planar alignment with a second side of said strip, said second side disposed on an opposite side of said longitudinal axis of said strip with respect to said fingers.

7. The jewelry support rack of claim 1 wherein said strip is formed of a plastic.

8. The jewelry support rack of claim 1 wherein said strip includes a plurality of strips.

9. The jewelry support rack of claim 1 wherein a longitudinal axis of each of said plurality of strips is disposed in parallel relationship with respect to each other and in a perpendicular relationship with respect to said pair of posts.

10. The jewelry support rack of claim 1 including a cabinet, wherein said cabinet includes means for retaining said pair of posts in said parallel spaced apart relationship with respect to each other.

11. The jewelry support rack of claim 1 including a brace, said brace including a pair of spaced apart holes on each end thereof that corresponds with the distance said pair of posts are disposed apart and wherein said pair of spaced apart holes are of greater inside diameter than the outside diameter of said posts, and wherein said brace is adapted to be disposed over said pair of posts whereby each of said pair of spaced apart holes is disposed over one of said pair of posts.

* * * * *